US005266458A

United States Patent [19]

Matsubayashi et al.

[11] Patent Number: 5,266,458

[45] Date of Patent: Nov. 30, 1993

[54] ELECTROPHOTOGRAPHIC DEVELOPER COMPRISING SILICON OIL ON ITS SURFACE

[75] Inventors: Nobuharu Matsubayashi; Shunji Konda; Takayuki Sano, all of Shizuoka, Japan

[73] Assignee: Tomoegawa Paper Co., Ltd., Tokyo, Japan

[21] Appl. No.: 755,758

[22] Filed: Sep. 6, 1991

[30] Foreign Application Priority Data

Sep. 11, 1990 [JP] Japan ..... 2-239112

[51] Int. Cl.[5] ..... G03G 9/083

[52] U.S. Cl. ..... 430/106.6; 430/137

[58] Field of Search ..... 430/106.6, 110, 137

[56] References Cited

U.S. PATENT DOCUMENTS 4,495,268 1/1985 Mijakawa ..... 430/106.6
4,640,880 2/1987 Kawanishi et al. ..... 430/106.6

FOREIGN PATENT DOCUMENTS 57-13868 3/1982 Japan .
59-197048 11/1984 Japan .

*Primary Examiner*—John Goodrow
*Attorney, Agent, or Firm*—Finnegan, Henderson, Farabow, Garrett & Dunner

[57] ABSTRACT

A developer for electrophotography is disclosed including a magnetic carrier and a magnetic toner having a surface, wherein a silicon oil is caused to adhere to the surface of the magnetic toner is provided.

13 Claims, No Drawings

ELECTROPHOTOGRAPHIC DEVELOPER COMPRISING SILICON OIL ON ITS SURFACE

BACKGROUND OF THE INVENTION

1. Field of the Invention

The present invention relates to a developer for electrophotography, which includes a magnetic toner and a magnetic carrier.

2. Prior Art

Conventional developing methods using static latent images and toners are roughly divided into two main classes. One is a two component type developing method using a two-component developer essentially consisting of a non-magnetic toner and a carrier. The other is a single-component type developing method using a single component developer essentially consisting of a magnetic toner.

The developing method using a two-component developer including a non-magnetic toner and a carrier has the following drawbacks:

(1) there is a need for a toner density sensor to control the ratio of the toner and the carrier;

(2) the life of the developer is short; and (3) a mixer for mixing the developer must be handled with care and a large developing machine must be present.

The single-component type developing method using a magnetic toner has the following disadvantages:

(1) an electrostatic charge element must be formed as a sleeve or a blade and has less electrostatic charge stability and capacity as compared with a carrier;

(2) there is a need for a precision developing machine to produce a uniform magnetic brush; and (3) the magnetic toner has fewer transferring, fixing, and environmental properties and produces more damage to photo-conductor than a non-magnetic toner.

In order to overcome the disadvantages described above, two-component developers using magnetic toners and various magnetic carriers have been proposed, and some of these have been practical. Such two-component developers have advantages in that:

(1) various levels of toner density are acceptable and a density sensor is unnecessary;

(2) a triboelectric charging is good due to the use of a carrier;

(3) there is no need for precision in the operating of the developing machine as is necessary in the single component type developing method since a magnetic brush is easily formed;

(4) toner scattering is less than in the case of the two-component developer since magnetic material is included in the toner; and (5) the developing unit can be as simplified as in the case of the single-component system due to the reduced need to stir the developer.

The two-component developing method using such a magnetic toner is proposed in U.S. Pat. No. 4,640,880 which discloses a developing method using a triboelectric magnetic toner and a ferrite carrier. In this method, the satisfied charge properties cannot be obtained in the case where toner ratio density is high in comparison with the usual non-magnetic toner employed in the two-component developer, i.e., the amount of the magnetic toner in the developer is not less than 20%. In addition, the image quality obtained by this method is not entirely adequate.

In the methods using magnetic toners, so-called incomplete copy images such as a b c, which may occur due to the decreased resistance of the toner and the failure of transferring, cannot be avoided. The magnetic toner is not acceptable with a minimum amount of this magnetic material. For this reason, it is difficult for the magnetic toner to maintain a toner resistance similar to the non-magnetic toner.

Hereinafter, some explanations will be given in connection with the so-called incomplete copy images. In the process of developing electrophotography, an image can be obtained by the steps of: developing a latent image on a photo-conductor with a toner on a sleeve to form a toner image; transferring the toner image on a paper sheet; and fixing the toner image to the paper sheet. Especially in the transferring step, the toner on the photo-conductor may not be uniformly transferred on the paper sheet and a part of the toner remains on the photo-conductor. As a result, the final transferred image may in part be missing. In particular, the center parts of the lines or dots of the image are frequently missing. An image having such a missing section is the so called "incomplete copy image".

In the developing method, the quality of the image is the most important consideration in practical use.

SUMMARY OF THE INVENTION

In order to solve the problems described above, it is an object of the present invention to provide a magnetic toner in which transfer properties similar to a non-magnetic toner can be maintained and which does not produce partial images such as the so-called incomplete copy image sometimes produced in the developing method using two-component developer.

One aspect of the present invention is directed to providing a developer for electrophotography consisting essentially of a magnetic carrier and a magnetic toner having a surface, wherein a silicon oil is caused to adhere to the surface of the magnetic toner.

The above objects, effects, features, and advantages of the present invention will become more apparent from the following description of preferred embodiments thereof.

DETAILED DESCRIPTION OF THE INVENTION

As a result of various studies, it has been found that causing a silicon oil (dimethylpolysiloxane) represented by formula (I) as follows:

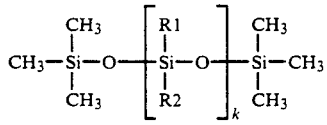

(I)

wherein k is a positive integer of 1 or more, R1 and R2 are individually selected from the group consisting of a phenyl group and an alkyl group having carbon atoms of 1 to 4, to adhere to the surface of the magnetic toner using a high-speed mixer such as a "Henschel Mixer", produced by Mitsui Miike Engineering Co., Ltd., or a "Super Mixer", produced by Kawada Mfg. Co. Ltd., contributes to reducing the incidence of the so-called incomplete copy images.

When the magnetic toner developed on the photo-conductor is transferred to the photo-conductor, the adhesion between the photo-conductor and the magnetic toner is primarily an electrostatic adhesion, and for this reason physical adhesion and frictional force between the magnetic toner particles are reduced. This is a reason why image quality is improved.

As a method for adding a silicon oil, for example, Japanese Patent Application Second Publication No. 57-13868 or Japanese Patent Application First Publication No. 59-197048 discloses a method comprising the steps of: adding a silicon oil to a magnetic toner to form a mixture; subsequently kneading the mixture; and subsequently pulverizing the kneaded mixture. This type of method has disadvantages in that it is difficult to uniformly diffuse a silicon oil due to the viscosity difference between the silicon oil and the thermoplastic resin because there is a need for a large amount of the silicon oil in order to produce desirable effects. Therefore, more silicon oil than the necessary is used in spite of the fact that the silicon oil is needed only on the surface of the toner, since the silicon oil is uniformly added into not only the surface but also the inside of the toner.

A toner with a large amount of the silicon oil exhibits desirable properties at first because of the migration property derived from the silicon oil being liquid. However, the toner becomes gradually unacceptable for practical use since the fluidity of the toner and triboelectric charging are degraded during use.

According to the present invention, a toner with a relatively small amount of a silicon oil can be provided by causing a small amount of the silicon oil to adhere to the surface of the magnetic toner using a high-speed mixer ("Henschel Mixer", produced by Mitsui Miike Engineering Co., Ltd., or "Super Mixer", produced by Kawada Mfg. Co. Ltd.,) or the like.

The silicon oil may be directly added to the magnetic toner in a high-speed mixer such as the "Henschel Mixer" or the "Super Mixer". In this case, the silicon oil is liable to form a nonuniform coating. Therefore, it would be better if the silicon oil were sprayed onto the magnetic toner.

The silicon oil used in the present invention may preferably have a viscosity of not more than 10,000 centistokes at 25° C.

If the viscosity of the silicon oil is above 10,000 centistokes, there are disadvantages such as the silicon oil is liable to form a nonuniform coating in the case of the direct addition thereof and it is difficult to spray the silicon oil with a nozzle in the case of the spray addition thereof.

The silicon oils used for improving the incomplete copy images described above include, for example, preferably the silicon oil represented by formula (I) and the modified silicon oil represented by formula (II), according to the triboelectric-charging property As a useful modified silicon oil, a methylstyrene-modified silicon oil, an olefin-modified silicon oil, a polyether-modified silicon oil, an alcohol-modified silicon oil, a fluorine-modified silicon oil, a hydrophilic-specially-modified silicon oil, an amino-modified silicon oil, a mercapto-modified silicon oil, an epoxy-modified silicon oil, a carboxy-modified silicon oil, a higher aliphatic acid-modified silicon oil, a carnauba-modified silicon oil, an amide-modified silicon oil, and the like may be used.

The modified silicon oil is represented by the following formula:

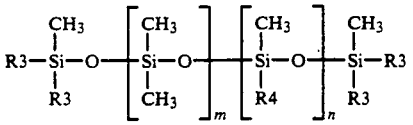

(II)

wherein R3 is a methyl group or a methoxy group, R4 is a substituent described above, and n or m is an integer of 1 or more.

For example, a methylstyrene-modified silicon oil is represented by the following formula:

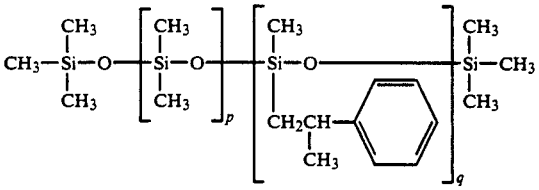

wherein p or q is an integer of 1 or more. An olefin-modified silicon oil is represented by the following formula:

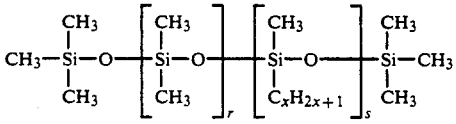

wherein r, s, or x is an integer of 1 or more. An amino-modified silicon oil is represented by the following formula:

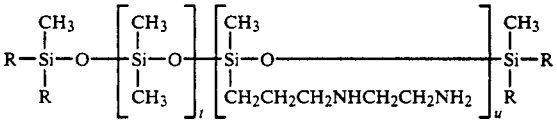

wherein R is selected from the group consisting of a methyl group and a methoxy group, and t or u is an integer of 1 or more. A mercapto-modified silicon oil is represented by the following formula:

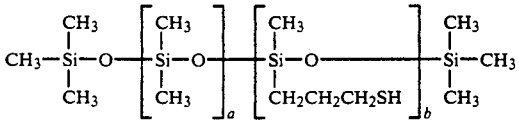

wherein a or b is an integer of 1 or more.

The silicon oils can be used alone or in combination therewith as required. The selection of the silicon oils or the molecular weight thereof depends on the physical properties of electric characteristics, fluidity, and the like. In the case where a small amount of the silicon oil having high viscosity is added to the magnetic toner, the silicon oil is dispersed with difficulty and is liable to form a nonuniform coating on the surface of the magnetic toner. If the amount of the silicon oil is relatively large, a silicon oil having high viscosity is acceptable.

According to the present invention, the amount of the silicon oil caused to adhere to the magnetic toner is preferably 0.01 part by weight to 1.0 part by weight per 100 parts by weight of the magnetic toner. If the amount of the silicon oil is below 0.01 part by weight, the objects according to the present invention described above cannot be achieved. On the other hand, if the silicon oil is present in the amount of the above 1.0 part by weight, the fluidity of the magnetic toner particles is not adequate.

The developing composition for electrophotography according to the present invention can be obtained by causing the silicon oil described above to adhere to the surface of the magnetic toner and mixing the magnetic carrier with the magnetic toner having the silicon oil adhered to the surface thereof.

The magnetic toner according to the present invention is formed by the steps of: dry-blending a magnetic powder, a binder resin, a charge control agent, and additives as necessary in the predetermined ratios; heat-melting and kneading the mixture by means of an extruder, roll-mill, or the like; pulverizing the kneaded mixture in a jet mill or the like; and classifying the pulverized mixture into the predetermined particle sizes. A fluid reforming agent and the like may be caused to adhere to the surfaces of the magnetic toner particles by a mixer such as "Henschel Mixer" as necessary.

As the magnetic powder of the magnetic toner according to the present invention, a metal such as cobalt, iron, nickel, or the like; an alloy of the metals selected from the group consisting of aluminum, cobalt, copper, iron, nickel, magnesium, tin, zinc, gold, silver, selenium, titanium, tungsten, zirconium, and the like; a metal oxide such as aluminum oxide, iron oxide, nickel oxide, or the like; ferromagnetite ferrite; magnetite; or the mixture thereof can be employed.

The magnetic powder having an average particle size of 0.1–3 μm is preferable.

The magnetic powder is preferably 30% by weight to 65% by weight based on the total weight of the magnetic toner. If the amount of the magnetic powder is less than 30% by weight based on the total weight of the magnetic toner, the intrinsic volume resistance of the magnetic toner becomes higher and the magnetic toner is liable to be charged and condensed because of the friction between the toner particles, and for this reason, the condensed magnetic toner causes fog density. On the other hand, in the case where the magnetic powder is present in the amount of more than 65% by weight based on the total weight of the magnetic toner, the intrinsic volume resistance of the magnetic toner becomes lower, and for this reason, the desired triboelectric charging with the carrier cannot be obtained and the image density is lowered.

Suitable binder resin for the toner according to the present invention may include, for example, a thermoplastic resin such as polystyrene, polyethylene, a vinyl resin, polyacrylate, polymethacrylate, polychlorovinylidene, polyacrylonitrile, polyether, polycarbonate, polyester, a cellulose resin, and a copolymer resin thereof; or a thermosetting resin such as a modified acryl resin, phenol resin, melamine resin, urea resin, or the like.

As a charge control agent, a conventional charge control agent useful for a toner can be employed. A suitable charge control agent preferably includes a nigrosine compound, a quaternary ammonium salt, and an ironic metal complex dye, especially one having a good triboelectric charging with the resin coated ferrite carrier described below.

Various additives added to the toner of the present invention as necessary include a coloring agent such as carbon black or the like, a fixer auxiliary agent such as polypropyrene having a low molecular weight, and the like. The fluid reformer caused to adhere to the surface of the toner includes a hydrophobic silica, a colloidal silica, and a fatty acid metallic salt.

On the other hand, the magnetic carriers used in the present invention may include any or all of the conventional ones. Preferably, for example, a granulated magnetite carrier or a ferrite carrier manufactured by the successive steps of spraying, drying, granulating, and heating can be employed in view of the desired magnetic force, the electrostatic charge properties, the form, and the like. In addition, the magnetic carrier may be coated by a resin coating on the surface thereof. The resin coating can produce stable electrostatic properties and thereby produce the good image properties and environmental stability.

In the developer for electrophotography according to the present invention, the magnetic toner is usually present in an amount of 25 parts by weight to 600 parts by weight per 100 parts by weight of the carrier.

EXAMPLES

The present invention will be explained in detail hereinbelow with reference to the examples. In the examples, all "parts" designate "parts by weight" and all "%" designate "% by weight".

EXAMPLE 1

| | |
|---|---|
| Compositions (EC1): | |
| Styrene/acrylic acid ester copolymer ("TTR-563", produced by Fujikura Kasei CO., LTD., Monomer composition: Styrene (St)/Methylmethacrylate (MMA)/ Butyl acrylate (BA), Mn = $0.5 \times 10^4$, Mw = $11.8 \times 10^4$) | 62 parts |
| Polypropyrene wax ("VISKOL 660P", produced by Sanyo Chemical Industries Co., Ltd.) | 2 parts |
| Magnetic material ("EPT-1100", produced by Toda Kogyo Corp.) | 35 parts |
| Charge control agent ("BONTRON S-34", produced by Orient Chemical Industries, Ltd.) | 1 part |

The mixture of the above-described compositions (EC1) was heat-melted and kneaded. The kneaded mixture was pulverized and classified by an extruding machine to obtain magnetic toner particles (EP1) having an average particle size of 12 μm. To the magnetic toner particles (EP1) (100 parts) was added 0.1 part of a silicon oil represented by formula (I) ("KF-96", produced by Shin'etsu Chemical Industries Co., Ltd., viscosity: 1000 CS) and mixed using a high-speed mixer ("Henschel Mixer", produced by Mitsui Miike Engineering Co., Ltd.) so as to cause the silicon oil to adhere uniformly to the magnetic toner particles. To the magnetic toner particles with the silicon oil was added 0.4 parts of a hydrophobic silica and stirred, whereby a magnetic toner of the present invention was obtained.

Next, a granulated magnetite carrier (average particle size = 46 μm, $\sigma s$ = 88 emu/g, coated by methylmethacrylate, intrinsic volume resistance = $10^{11}$ Ω.cm) as a magnetic carrier was mixed with the magnetic toner obtained above so that the magnetic toner is presented in the amount of 30% based on the total weight of a developer, thus obtaining the developer according to the present invention.

A continuous copying test was carried out using the developer of the present invention by means of a printer for electrophotography ("JX-9500", produced by Sharp Corporation). As a result, the printed matter exhibited good image quality as well as good image density.

COMPARATIVE EXAMPLE 1

Magnetic toner particles (CP1) (100 parts) were prepared using the same compositions (EC1) by repeating the same procedures as described in Example 1. A comparative magnetic toner was formed by adding only a hydrophobic silica of 0.4 parts to the magnetic toner particles (CP1).

The same continuous copying test as described in Example 1 was carried out using a comparative developer (CD1) prepared using the magnetic toner particles (CP1) with the hydrophobic silica by repeating the same procedure as described in Example 1.

As a result, the printed matter exhibited good image density. However, in the case where images were copied on a thick paper or a film for an overhead projector (OHP), a so-called incomplete copy image was obtained, and for this reason, the image quality was not satisfactory.

COMPARATIVE EXAMPLE 2

The compositions (EC1) (100 parts) described in Example 1 and 0.1 part of a silicon oil ("KF-96", produced by Shin'etsu Chemical Industries Co., Ltd., viscosity: 1000 CS) were heat-melted and kneaded. The kneaded mixture was pulverized and classified by an extruding machine to obtain magnetic toner particles (CP2). A comparative magnetic toner was prepared by adding a hydrophobic silica of 0.4 parts to the magnetic toner particles (CP2).

The same continuous copying test as described in Example 1 was carried out using a comparative developer (CD2) prepared using the magnetic toner particles (CP2) with the hydrophobic silica by repeating the same procedures as described in Example 1.

As a result, the printed matter exhibited good image density without fog density. However, a so-called incomplete copy image was produced and the image quality was not improved.

COMPARATIVE EXAMPLE 3

A comparative developer (CD3) was obtained by repeating the same procedures as described in Comparative Example 2 except that the amount of the 0.1 part of a silicon oil ("KF-96", produced by Shin'etsu Chemical Industries Co., Ltd., viscosity: 1000 CS) was 2.0 parts instead of 0.1 part as in Comparative Example 2.

The same continuous copying test as described in Example 1 was carried out using the comparative developer (CD3).

As a result, the printed matter exhibited good image density without fog density and had an improved incomplete copy image.

However, after the comparative developer (CD3) was stored at ordinary temperature and humidity for one month, the stored comparative developer (CD3) was not acceptable for practical use since the fluidity of the stored developer (CD3) was degraded and the developer (CD3) could not be smoothly supplied from a toner hopper.

The results described above are shown in Table 1. The image density in Table 1 was measured by process measurements Macbeth RD-914 and fog density in Table 1 was measured by brightness by Hunter. The number shown in Table 1 in connection with "Outlined image" designates the number of incomplete copy images per 30 images when thirty letters of "i" were printed on a paper sheet.

TABLE 1

| Sample | Image density | Fog density | Incomplete copy image | Remarks |
|---|---|---|---|---|
| Example 1 | 1.42 | 0.34 | 0/30 | — |
| Comparative Example 1 | 1.43 | 0.42 | 25/30 | — |
| Comparative Example 2 | 1.41 | 0.51 | 23/30 | — |
| Comparative Example 3 | 1.42 | 0.38 | 3/30 | degraded over time |

EXAMPLE 2

| | |
|---|---|
| Compositions (EC2): | |
| Styrene/acrylic acid ester copolymer ("F-603", produced by Seiko Chemical Industries Co., Ltd., | 60 parts |
| Monomer composition: | |
| Styrene (St)/2-ethylhexylacrylate (2EHA) $Mn = 0.9 \times 10^4$, $Mw = 25.4 \times 10^4$) | |
| Polypropyrene wax ("VISKOL 550P", produced by Sanyo Chemical Industries Co., Ltd.) | 2 parts |
| Magnetic material ("EPT-500", produced by Toda Kogyo Corp.) | 37 parts |
| Charge control agent ("BONTRON S-34", produced by Orient Chemical Industries, Ltd.) | 1 part |

The mixture of the above-described compositions (EC2) was heat-melted and kneaded. The kneaded mixture was pulverized and classified by an extruding machine to obtain magnetic toner particles (EP2) having an average particle size of 10 μm. To the magnetic toner particles (EP2) (100 parts) was added 0.1 part of a carboxy modified silicon oil represented by formula (II) ("X-22-3715", produced by Shin'etsu Chemical Industries Co., Ltd., viscosity: 200 CS) and mixed using a high-speed mixer ("Henschel Mixer", produced by Mitsui Miike Engineering Co., Ltd.) so as to cause the silicon oil to adhere uniformly to the magnetic toner particles. To the magnetic toner particles with the silicon oil was added 0.4 parts of hydrophobic silica and the mixture was stirred, whereby a magnetic toner of the present invention was obtained.

Next, a granulated magnetite carrier (average particle size = 46 μm, $\sigma s = 82$ emu/g, coated by silicone, intrinsic volume resistance = $10^{11}$ Ω.cm) as a magnetic carrier was mixed with the magnetic toner obtained above so that the magnetic toner is present in the amount of 25% based on the total weight of developer, thus obtaining the developer according to the present invention.

A continuous copying test was carried out using the developer of the present invention by means of a printer for electrophotography ("JX-9500", produced by Sharp Corporation). As a result, the printed matter exhibited good image quality as well as good image density.

COMPARATIVE EXAMPLE 4

Magnetic toner particles (EP2) were prepared using the same compositions (EC2) by repeating the same procedures as described in Example 2. A comparative magnetic toner was formed by adding only a hydrophobic silica of 0.4 parts to the magnetic toner particles (CP4) (100 parts).

The same continuous copying test as described in Example 2 was carried out using a comparative developer (CD4) prepared using the magnetic toner particles (CP4) with the hydrophobic silica by repeating the same procedure as described in Example 2.

As a result, the printed matter exhibited good image density. However, in the case where the image was copied on a thick paper or on a film for an overhead projector (OHP), a so called incomplete copy image was obtained, and for this reason, the image quality was not satisfactory.

COMPARATIVE EXAMPLE 5

The compositions (EC2) (100 parts) described in Example 2 and 0.1 part of a silicon oil ("X-22-3715", produced by Shin'etsu Chemical Industries Co., Ltd., viscosity: 200 CS) were heat-melted and kneaded. The kneaded mixture was pulverized and classified by an extruding machine to obtain magnetic toner particles (CP5). A comparative magnetic toner was prepared by adding a hydrophobic silica of 0.4 parts to the magnetic toner particles (CP5).

The same continuous copying test as described in Example 2 was carried out using a comparative developer (CD5) prepared using the magnetic toner particles (CP5) with the hydrophobic silica by repeating the same procedures as described in Example 2.

As a result, the printed matter exhibited good image density without fog density. However, a so-called incomplete copy image was produced and the image quality was not improved over the prior art.

COMPARATIVE EXAMPLE 6

A comparative developer (CD6) was obtained by repeating the same procedures as described in Comparative Example 5 except that the amount of silicon oil ("X-22-3715", produced by Shin'etsu Chemical Industries Co., Ltd., viscosity: 200 CS) was 2.0 parts instead of the 0.1 part in Comparative Example 5.

The same continuous copying test as described in Example 1 was carried out using the comparative developer (CD6).

As a result, the printed matter exhibited good image density without fog density and had an improved incomplete copy image.

However, after the comparative developer (CD6) was stored at ordinary temperature and humidity for two months, the stored comparative developer (CD6) was not acceptable for practical use since the fluidity of the stored developer (CD6) was degraded and the developer (CD6) could not be smoothly supplied from a toner hopper.

The results obtained above are shown in Table 2. The image density in Table 2 was measured by process measurements Macbeth RD-914 and fog density in Table 2 was measured by brightness by Hunter. The number shown in Table 1 in connection with "Outlined image" is the number of the incomplete copy images per 30 images when thirty letters of "i" were printed on a paper.

TABLE 2

| Sample | Image density | Fog density | Incomplete copy image | Remarks |
|---|---|---|---|---|
| Example 2 | 1.40 | 0.55 | 2/30 | — |
| Comparative Example 4 | 1.41 | 0.63 | 27/30 | — |
| Comparative Example 5 | 1.43 | 0.49 | 26/30 | — |
| Comparative Example 6 | 1.42 | 0.56 | 3/30 | degraded over time |

EXAMPLE 3

| Compositions (EC3): | |
|---|---|
| Styrene/acrylic acid ester copolymer ("P-292", produced by Sekisui Chemical Co., Ltd., Monomer composition: Styrene (St)/Methylmethacrylate (MMA)/ Butyl acrylate (BA)/ Dimethylaminoethylacrylate (DMAEA) Mn = $0.54 \times 10^4$, Mw = $12.8 \times 10^4$) | 59 parts |
| Polypropyrene wax ("VISKOL 550P", produced by Sanyo Chemical Industries Co., Ltd.) | 2 parts |
| Magnetic material ("EPT-1000", produced by Toda Kogyo Corp.) | 37 parts |
| Charge control agent ("BONTRON N-04", produced by Orient Chemical Industries, Ltd.) | 1 part |

The mixture of the above-described compositions (EC3) was heat-melted and kneaded. The kneaded mixture was pulverized and classified by an extruding machine to obtain magnetic toner particles (EP3) having an average particle size of 11 μm. To the magnetic toner particles (EP3) (100 parts) was added 0.08 parts of a amino modified silicon oil represented by formula (II) ("X-22-3680", produced by Shin'etsu Chemical Industries Co., Ltd., viscosity: 90 CS) and mixed using a high-speed mixer ("Henschel Mixer", produced by Mitsui Miike Engineering Co., Ltd.) so as to cause the silicon oil to adhere uniformly to the magnetic toner particles. To the magnetic toner particles with the silicon oil was added 0.4 parts of a hydrophobic silica and stirred, whereby a magnetic toner of the present invention was obtained.

Next, a granulated magnetite carrier (average particle size = 50 μm, $\sigma s = 89$ emu/g, coated by fluorine, intrinsic volume resistance = $10^{11}$ Ω.cm) as a magnetic carrier was mixed with the magnetic toner obtained above so that the magnetic toner was present in the amount of 70% based on the total weight of developer, thus obtaining the developer according to the present invention.

The continuous copying test as described in Example 1 was carried out using the developer according to the present invention by means of a modified printer for electrophotography wherein a photo-conductor, a bias supply, and a transfer corona polarity of a printer for electrophotography ("Electrophotography Printer 1305 B", produced by Tokyo Electric Co., Ltd.) have been modified for plus toners.

As a result, the printed matter exhibited good image quality as well as good image density.

COMPARATIVE EXAMPLE 7

Magnetic toner particles (EP3) were prepared using the same compositions (EC3) by repeating the same procedures as described in Example 3. A comparative magnetic toner was formed by adding only a hydrophobic silica of 0.4 parts to the magnetic toner particles (CP7) (100 parts) without adding an amino modified silicon oil.

The same continuous copying test as described in Example 3 was carried out using a comparative developer (CD7) prepared using the magnetic toner particles (CP7) with the hydrophobic silica by repeating the same procedure as described in Example 3.

As a result, the printed matter exhibited good image density. However, in the case where the image was copied on a thick paper or on a film for an overhead projector (OHP), a so-called incomplete copy image was obtained, and for this reason, the image quality was not satisfactory.

EXAMPLES 4 TO 7 AND COMPARATIVE EXAMPLES 8 TO 10

Developers according to Examples 4 to 7 and comparative developers according to Comparative Examples 8 to 10 were produced by repeating the same procedures as described in Example 1 except that the amount of silicon oil ("KF-96", produced by Shin'etsu Chemical Industries Co., Ltd., viscosity: 1000 CS) of each of the developers of the present invention and the comparative developers was varied as shown in Table 3. The amount of the silicon oil described in Table 3 was based on 100 parts of the magnetic toner corresponding to each of developers according to Examples 4 to 7 and comparative developers of Comparative Examples 8 to 10.

The same continuous copying test as described in Example 1 was carried out using developers according to Examples 4 to 7 and comparative developers according to Comparative Examples 8 to 10.

As a result, in the case where the developers according to Example 1 and Examples 4 to 7 were used (i.e. the amount of the silicon oil in the magnetic toner of the developer is 0.01 part by weight to 1.0 part by weight), the printed matter exhibited good image density, fog density, and incomplete copy image. However, in the case where the amount of the silicon oil in the magnetic toner is outside of the range of 0.01 part by weight to 1.0 part by weight, for example, in Comparative Examples 8 to 10, the number of so-called incomplete copy images was increased, the fluidity of the toner was deteriorated, and a lot of fog copy images were obtained. For this reason, the image quality was not satisfactory.

TABLE 3

| Sample | The amount of the silicon oil (parts by weight) | Image density | Fog density | Incomplete copy image | Remarks |
|---|---|---|---|---|---|
| Comparative Example 8 | 0.005 | 1.40 | 0.47 | 15 | |
| Example 4 | 0.01 | 1.41 | 0.40 | 5 | |
| Eample 5 | 0.05 | 1.40 | 0.39 | 3 | |
| Example 1 | 0.1 | 1.42 | 0.34 | 0 | |
| Example 6 | 0.5 | 1.41 | 0.43 | 2 | |
| Example 7 | 1.0 | 1.40 | 0.51 | 1 | |
| Comparative Example 9 | 1.5 | 1.42 | 0.71 | 2 | Poor fluidity |
| Comparative Example 10 | 2.0 | 1.41 | 0.80 | 1 | Poor fluidity |

As will be apparent from the results shown above, a two-component developer according to the present invention having a magnetic toner and a magnetic carrier exhibits superior transferring equal to that of a non-magnetic toner without the so-called incomplete copy images by causing a silicon oil or a modified silicon oil derived from polydimethylsiloxane to adhere to the surface of the magnetic toner.

The present invention has been described in detail with respect to embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A developer for electrophotography consisting essentially of a magnetic carrier and a magnetic toner having a surface, wherein a silicon oil is adhered substantially to the surface of said magnetic toner.

2. A developer for electrophotography as recited in claim 1, wherein said silicon oil is dimethylpolysiloxane.

3. A developer for electrophotography as recited in claim 1, wherein said silicon is at least one modified silicon oil, said oil being a methylstyrene-modified silicon oil, an olefin-modified silicon oil, a polyether-modified silicon oil, an alcohol-modified silicon oil, a fluorine-modified silicon oil, a hydrophilic-specially-modified silicon oil, an amino-modified silicon oil, a mercapto-modified silicon oil, an epoxy-modified silicon oil, a carboxy-modified silicon oil, a higher aliphatic acid-modified silicon oil, a carnauba-modified silicon oil, or an amide-modified silicon oil.

4. A developer for electrophotography recited in claim 1, wherein said silicon oil is present in the amount of 0.01 part by weight to 1.0 part by weight per 100 parts by weight of said magnetic toner.

5. A developer for electrophotography recited in claim 1, wherein said silicon oil has viscosity of not more than 10,000 centistokes at 25° C.

6. A developer for electrophotography as recited in claim 1, further comprising a binder resin and a charge control agent.

7. A developer for electrophotography as recited in claim 6, wherein said binder resin is polystyrene, polyethylene, a vinyl resin, polyacrylate, polymethacrylate, polychlorovinylidene, polyacrylonitrile, polyether, polycarbonate, polyester, a cellulose resin, a copolymer resin thereof; a modified acryl resin, phenol resin, melamine resin, or urea resin; and wherein said charge control agent is a nigrosine compound, a quaternary ammonium salt, or an ironic metal complex dye.

8. A developer for electrophotography as recited in claim 1, wherein said magnetic toner comprises a magnetic powder in the amount 30% by weight to 65% by weight based on the total weight of said magnetic toner.

9. A developer for electrophotography as recited in claim 8, wherein said magnetic powder is cobalt, iron, nickel; an alloy of the metals selected from the group consisting of aluminum, cobalt, copper, iron, nickel, magnesium, tin, zinc, gold, silver, selenium, titanium, tungsten, zirconium, and the like; aluminum oxide, iron oxide, nickel oxide; ferromagnetite ferrite; magnetite; or mixtures thereof.

10. A developer for electrophotography consisting essentially of a magnetic carrier and a magnetic toner having a surface, wherein the magnetic toner is manufactured by the steps of: preparing a mixture of a magnetic powder, a binder resin, a charge control agent, and additives as necessary in predetermined ratios; dry-blending the mixture; heat-melting-and kneading the blended mixture; pulverizing the kneaded mixture; classifying the pulverized mixture into a predetermined particle size; and mixing the classified mixture with a silicon oil by means of a high-speed mixer.

11. A developer for electrophotography as recited in claim 10, wherein said silicon oil is dimethylpolysiloxane.

12. A developer for the electrophotography as recited in claim 10, wherein said silicon oil is at least one modified silicon oil, said oil being a methylstyrene-modified silicon oil, an olefin-modified silicon oil, a polyether-modified silicon oil, an alcohol-modified silicon oil, a fluorine-modified silicon oil, a hydrophilic-specially-modified silicon oil, an amino-modified silicon oil, a mercapto-modified silicon oil, an epoxy-modified silicon oil, a carboxy-modified silicon oil, a higher aliphatic acid-modified silicon oil, a carnauba-modified silicon oil, or an amide-modified silicon oil.

13. A developer for electrophotography as recited in claim 10, wherein said silicon oil is present in the amount of 0.01 part by weight to 1.0 part by weight per 100 parts by weight of the magnetic toner.

* * * * *

UNITED STATES PATENT AND TRADEMARK OFFICE

CERTIFICATE OF CORRECTION

PATENT NO. : 5,266,458

DATED : November 30, 1993

INVENTOR(S) : Nobuharu Matsubayashi et al.

It is certified that error appears in the above-indentified patent and that said Letters Patent is hereby corrected as shown below:

Claim 10, column 13, line 12, change "heat-melting-and" to --heat-melting and --.

Signed and Sealed this

Twentieth Day of September, 1994

*Attest:*

Bruce Lehman

BRUCE LEHMAN

*Attesting Officer*

*Commissioner of Patents and Trademarks*